US006302642B1

(12) United States Patent
Nagler et al.

(10) Patent No.: US 6,302,642 B1
(45) Date of Patent: Oct. 16, 2001

(54) HEAT SHIELD FOR A GAS TURBINE

(75) Inventors: Christoph Nagler, Zürich (CH); Christof Pfeiffer, Küssaberg (DE); Ulrich Wellenkamp, Windisch (CH)

(73) Assignee: ABB Alstom Power (Schweiz) AG, Baden (CH)

( * ) Notice: Subject to any disclaimer, the term of this patent is extended or adjusted under 35 U.S.C. 154(b) by 0 days.

(21) Appl. No.: 09/551,565

(22) Filed: Apr. 18, 2000

(30) Foreign Application Priority Data

Apr. 29, 1999 (DE) ..... 199 19 654

(51) Int. Cl.[7] ..... F04D 31/00
(52) U.S. Cl. ..... 415/116; 416/173.1; 416/191
(58) Field of Search ..... 415/116, 199.5, 415/174.2, 173.1, 220, 221, 176; 416/189, 191

(56) References Cited

U.S. PATENT DOCUMENTS 4,177,004 12/1979 Reidmiller et al. .
4,526,226 * 7/1985 Hsia et al. ..... 165/109 R
4,551,064 11/1985 Pask .
4,573,865 * 3/1986 Hsia et al. ..... 415/115
5,071,313 12/1991 Nichols .
5,584,651 12/1996 Pietraszkieciz et al. .
6,126,389 * 10/2000 Burdgick ..... 415/115
6,224,329 * 5/2001 North ..... 415/116

FOREIGN PATENT DOCUMENTS 27 37 622 5/1978 (DE) .

* cited by examiner

*Primary Examiner*—Edward K. Look
*Assistant Examiner*—J M McAleenan
(74) *Attorney, Agent, or Firm*—Burns, Doane, Swecker & Mathis, L.L.P.

(57) ABSTRACT

A heat shield for a gas turbine, which heat shield encloses in an annular manner the moving blades, rotating in the hot-gas duct of the gas turbine, of a stage of the gas turbine and consists of a plurality of heat-shield segments which are arranged one behind the other in the circumferential direction, are curved in the shape of a segment of a circle and are cooled from outside, and the longitudinal sides which are designed as correspondingly curved rails running in the circumferential direction and having in each case a pair of arms of which project in the axial direction, run in parallel and are at a distance from one another, the heat-shield segments, while forming a cavity to which cooling air can be admitted, are fastened to the inside of an annular carrier, which concentrically surrounds the heat shield in such a way that in each case a radial gap is formed between the longitudinal sides of heat-shield segments and the adjacent elements which define the hot-gas duct on the outside.

9 Claims, 4 Drawing Sheets

FIG. 9
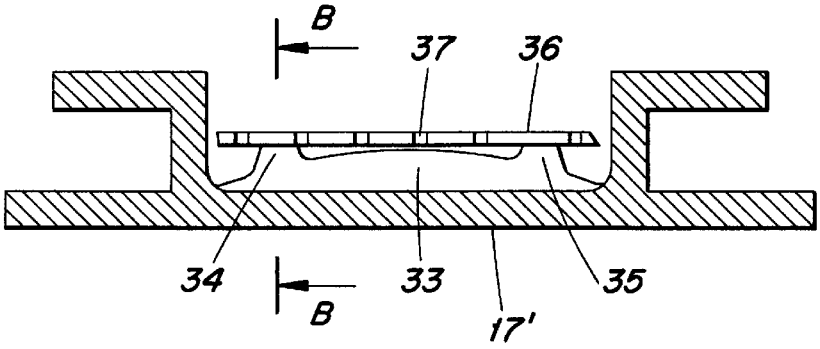
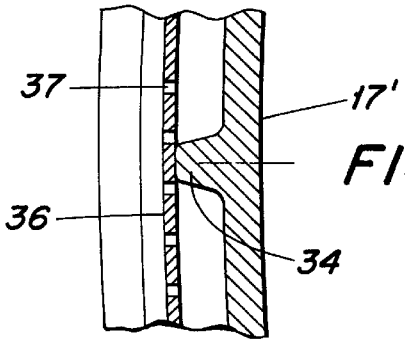
FIG. 10
FIG. 11
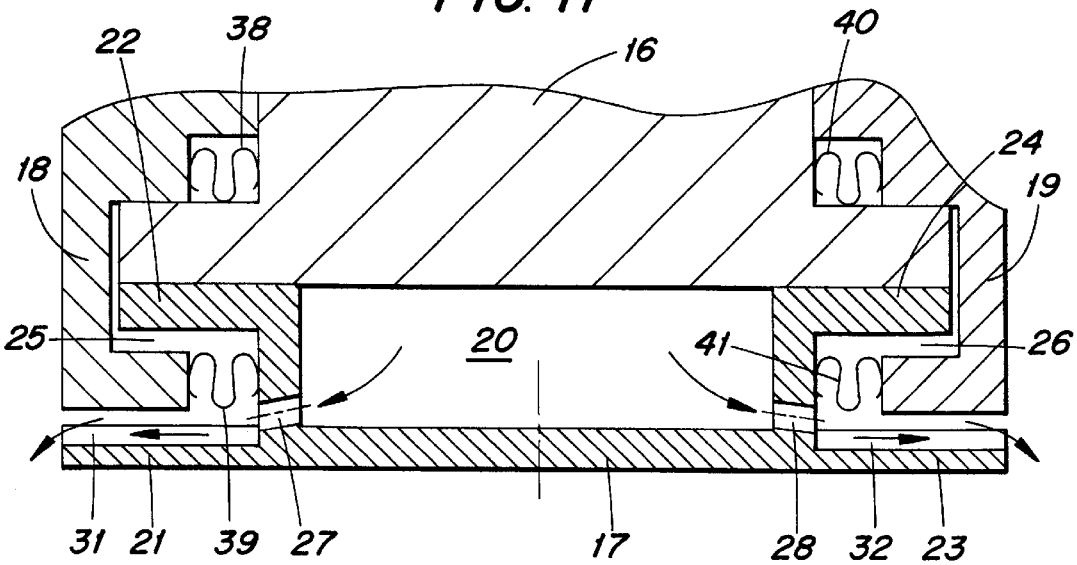

HEAT SHIELD FOR A GAS TURBINE

BACKGROUND AND SUMMARY OF THE INVENTION

The present invention relates to the field of technology of gas turbines. It concerns a heat shield for a gas turbine, which heat shield encloses in an annular manner the moving blades, rotating in the hot-gas duct of the gas turbine, of a stage of the gas turbine and consists of a plurality of heat-shield segments which are arranged one behind the other in the circumferential direction, are curved in the shape of a segment of a circle and are cooled from outside, and the longitudinal sides of which are designed as correspondingly curved rails (which may be either continuous or discontinuous) running in the circumferential direction and having in each case a pair of arms which project in the axial direction, run in parallel and are at a distance from one another, the heat-shield segments, while forming a cavity to which cooling air can be admitted, are fastened to the inside of an annular carrier, which concentrically surrounds the heat shield in such a way that in each case a radial gap is formed between the longitudinal sides of the heat-shield segments and the adjacent elements which define the hot-gas duct on the outside.

Such a heat shield has been disclosed, for example, by the publications U.S. Pat. Nos. 4,177,004, 4,551,064, 5,071, 313, 5,584,651 or EP-A1-0 516 322.

Heat shields for gas turbines, which surround the moving blades of a turbine stage in an annular manner and, on the one hand, define the hot-gas duct on the outside and, on the other hand, keep the gap between the outer wall of the hot-gas duct and the ends of the moving blades as small as possible for reasons of efficiency without causing abrasive contact during fluctuating temperatures, have been known for a long time. Such heat shields normally consist of a multiplicity of heat-shield segments which are curved in the shape of a segment of a circle and, arranged one behind the other in the circumferential direction, form a closed ring.

The individual heat-shield segments are often detachably fastened to a carrier, which concentrically surrounds the heat shield. In this case, on account of the different thermal expansion of the various individual parts, care is taken to ensure that radial gaps or annular-gap-shaped cavities remain free between the heat-shield segments and the adjacent elements which define the hot-gas duct on the outside.

The heat shield or the individual heat-shield segments are subjected to high thermal loading during operation of the gas turbine. One the one hand, this thermal loading may have adverse effects on the heat shield itself. On the other hand, the heat may be conducted outward through the shield and cause damage there. Measures are therefore normally taken in order to suitably cool the heat-shield segments from the rear or outside by compressed cooling air, which usually originates from the compressor part of the gas turbine or the plenum. This cooling is to be as even and as efficient as possible and is to include all the loaded regions of the heat shield. In addition, hot gas should be prevented from penetrating into the adjacent gaps in the outer wall of the hot-gas duct and undesirably heating the parts of the construction which lie behind it.

A heat shield for a gas turbine is disclosed in U.S. Pat. No. 4,177,004 (FIGS. 1, 2 and 4 there), in which cooling air is fed from the cavity (52) lying behind the heat-shield segments through cooling holes (66) into the adjacent intermediate space (48) only on the downstream longitudinal side of the heat-shield segments and is directed from the intermediate space (48) through cooling slots (67) in the clamp part (43) into the hot-gas duct (FIG. 4, FIG. 5). In contrast, cooling air is only passed externally around the upstream longitudinal side of the heat-shield segments (FIG. 3) and flows in other ways into the cavity (62) lying behind them. This arrangement has the disadvantage that the heat-shield segment as a whole is cooled unevenly, since cooling from the rear virtually does not take place on that longitudinal side of the heat-shield segment which is oriented upstream. A further disadvantage is that the cooling slots (67) have been made in the clamp element (43), which in terms of manufacture leads to a considerable extra cost.

In the solution described in U.S. Pat. No. 4,551,064, (angled) cooling holes (55) are also arranged only in the region of the downstream longitudinal edge of the heat-shield segment. Both gaps (64, 68) adjacent to the heat-shield segments are flooded by cooling-air flows (59 and 65 resp. in FIG. 1) which are fed through separate holes (63, 67) from outside the heat shield.

Disclosed in U.S. Pat. No. 5,584,651 is a heat shield in whose segments an inner cavity (38) is formed in the upstream edge (FIG. 2), and the cooling air flows through this cavity (38) and discharges through outlet holes (44), arranged directly at the edge, into the hot-gas duct. On the other hand, in the marginal region located downstream or in the region of the segments there, no special cooling is provided, so that very uneven cooling of the heat-shield segments can be expected in this case too. The downstream inner arms of the heat-shield segments with the edges **(28*b* in FIG. 1)** are especially affected by this.

Somewhat more extensive cooling is achieved by the cooling holes (80) extending further downstream in the heat shield from EP-Al-0 516 322. Here too, however, the downstream longitudinal edge of the heat shields with the inner arms (44) is virtually uncooled.

The object of the invention is therefore to provide a heat shield for a gas turbine, which heat shield avoids the disadvantages of known heat shields and, with at the same time a simple construction, is distinguished by efficient and even cooling over the entire thermally loaded area of the heat-shield segments and in particular of the inner arms projecting axially on the longitudinal edges.

The object is achieved by all the features of claim 1. The essence of the invention consists in directing cooling air from the cavity lying behind the segments through corresponding cooling holes into the adjacent gaps at both longitudinal sides of the heat shields, that is, both upstream and downstream, and thus in also simultaneously and evenly cooling the two longitudinal-edge regions of the heat-shield segments and flooding the gaps to prevent an ingress of hot gases. In this case, all the cooling and flooding features are arranged (in the form of cooling holes or cooling slots) on the heat-shield segment itself, which substantially facilitates the manufacture and makes it unnecessary to adapt the other parts of the heat-shield duct. The outflow of the cooling air at both longitudinal sides of the heat-shield segments also results in the cooling air sweeping more evenly over the outsides, defining the cavity, of the segments and thus evenly cooling the entire segment area. As a result, the thermal loading over the entire area is evenly reduced and the service life of the heat-shield segments is significantly prolonged.

A first preferred embodiment of the heat shield according to the invention is characterized in that the heat-shield segments are fastened to the carrier by means of clamps, which, with ends bent inward in an L-shape, engage from both sides under the carrier in the intermediate spaces formed between the arm pairs, in that the cooling air flowing out of the cooling holes is directed in the intermediate spaces between the ends, bent inward in an L-shape, of the clamps and the inner arms of the heat-shield segments to the gaps, and in that cooling slots in alignment with the cooling holes are made in the outsides of the inner arms in order to direct the cooling air discharging from the cooling holes. Due to the cooling slots in the inner arms, the heat-transfer area at the arms is increased and the cooling of the arms (furthest away from the cavity filled with cooling air) is substantially evened out and improved.

A second preferred embodiment of the heat shield according to the invention is characterized in that, to reduce the deflection of the heat shield during temperature changes, axially running stiffening ribs are arranged or integrally formed on the outside of the heat-shield segments in the region of the cavity, in that an impingement-cooling plate running in the circumferential direction and provided with openings is arranged inside the cavity and at a distance from the outside of the heat-shield segments, and in that individual lugs or pins, which project radially outward and on which the impingement-cooling plate is supported, are arranged inside the stiffening ribs. The stiffening ribs with the formed lugs stiffen the heat-shield segments in the axial direction and thereby reduce the risk of the moving blades grazing against the heat shield. In addition, they improve the heat transfer between the segment and the cooling air flowing through the cavity. In this case, the lugs, which serve to support the impingement-cooling plate, may be formed together with the stiffening ribs in a simple manner during the casting of the segments.

The cooling air is effectively prevented from flowing off undesirably from the gaps if, in a further preferred embodiment of the invention, first axial elastic seals are arranged above the cooling holes between the clamps and the longitudinal sides of the heat-shield segments.

Further embodiments follow from the dependent claims.

BRIEF DESCRIPTION OF THE DRAWINGS

The invention is to be explained in more detail below with reference to exemplary embodiments in connection with the drawing, in which:

FIG. 9 shows the heat-shield segment from FIG. 6 with supported impingement-cooling plate;

FIG. 10 shows the section through the heat-shield segment from FIG. 9 in the section plane B—B; and FIG. 11 shows another exemplary embodiment of a heat shield according to the invention with multiple axial seals for preventing a loss of cooling air in the gaps.

DETAILED DESCRIPTION OF THE PREFERRED EMBODIMENT

Figure 1:
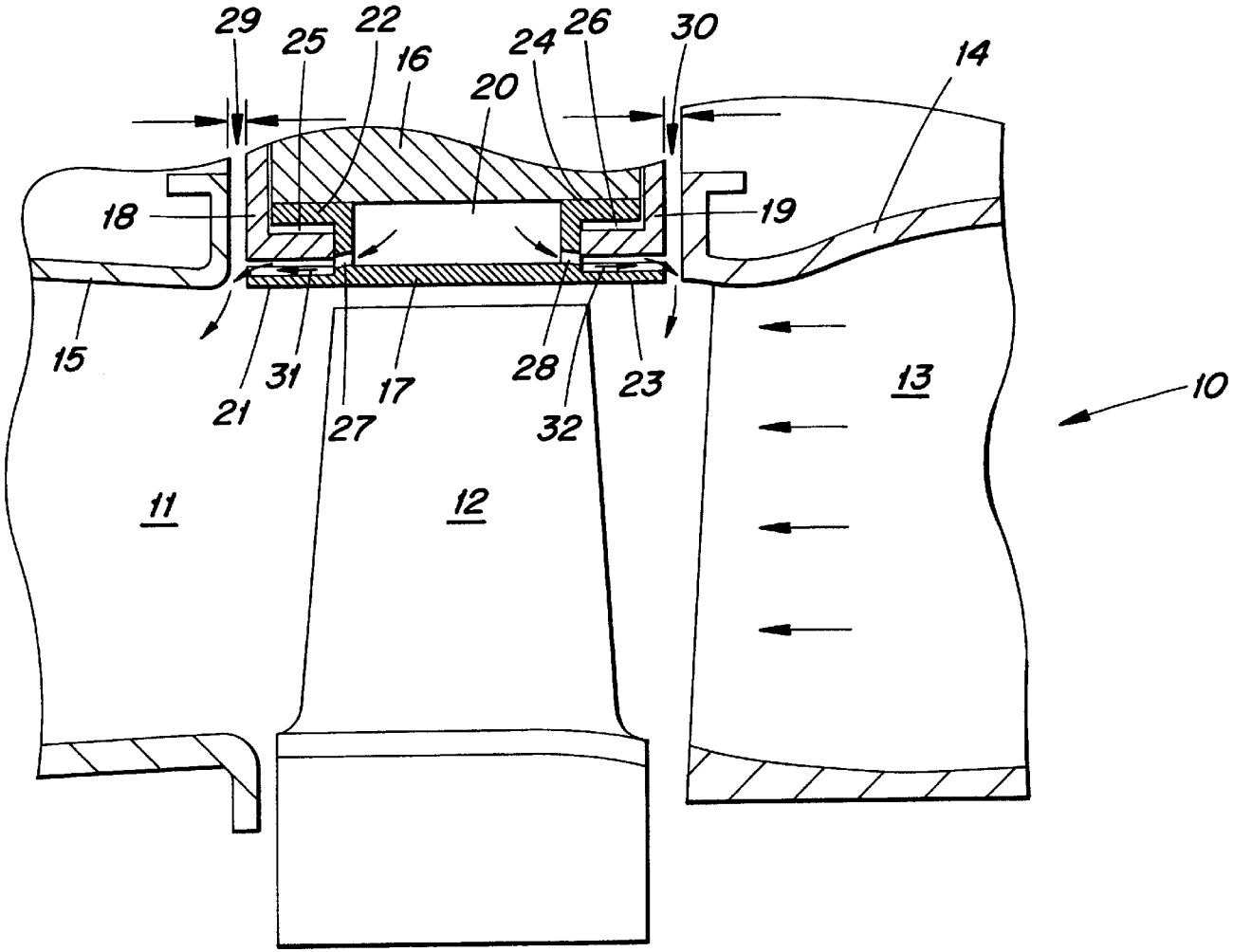
FIG. 1 shows a detail, in partial longitudinal section, of the arrangement of a heat shield in a gas turbine in a first preferred exemplary embodiment of the invention.

A detail of the partly longitudinally sectioned arrangement of a heat shield in a gas turbine 10 in a first preferred exemplary embodiment of the invention is shown in FIG. 1. The figure shows a detail of the (rotationally symmetrical) hot-gas duct 11 of the gas turbine, through which the hot combustion gases from the combustion chamber (not shown) of the gas turbine flow in the direction of the four parallel arrows depicted. Arranged in the hot-gas duct 11 are guide blades 13, which extend in the radial direction and merge at their outer end into an outer ring 14, which defines the hot-gas duct 11 on the outside in the region of the guide blades 13. Following the guide blades 13 downstream are moving blades 12, which are fastened to a rotor (not shown) of the gas turbine and rotate together with this rotor about the turbine axis when the hot gas flowing in the hot-gas duct 11 is admitted to them. Further guide-blade and moving-blade rings, to which further reference need not be made here, may follow downstream behind the ring of moving blades 12. In any case, the hot-gas duct 11 is defined on the outside behind the moving blades 12 by an intermediate ring 15 or by a guide blade following behind it.

Figure 2:
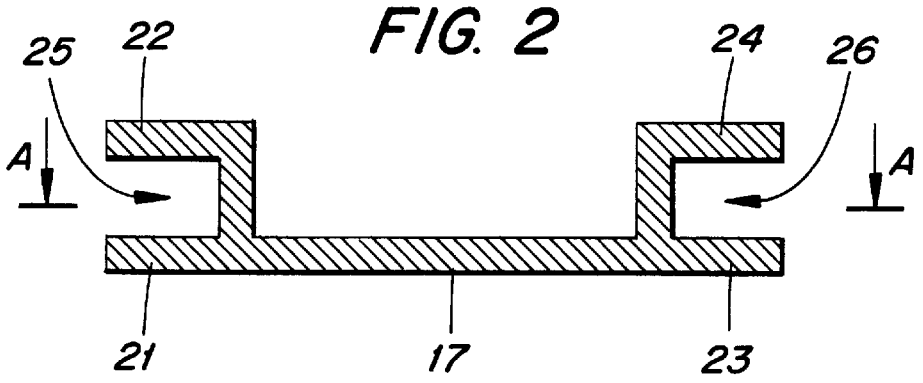
FIG. 2 shows the cross section through a segment of the heat shield according to FIG. 1 (without representation of the cooling holes and slots)

The ring of moving blades 12 is concentrically surrounded by a heat shield, which is composed of a multiplicity of individual heat-shield segments 17 curved in the shape of a segment of a circle and arranged one behind the other in the circumferential direction. Such a heat-shield segment 17 is reproduced in cross section inside the overall arrangement in FIG. 1 and by itself in FIG. 2. The heat shield as a whole defines the hot-gas duct 11 in the region of the moving blades 12 and at the same time determines the gap between the duct wall and the outer end of the moving blades 12.

Figure 3:
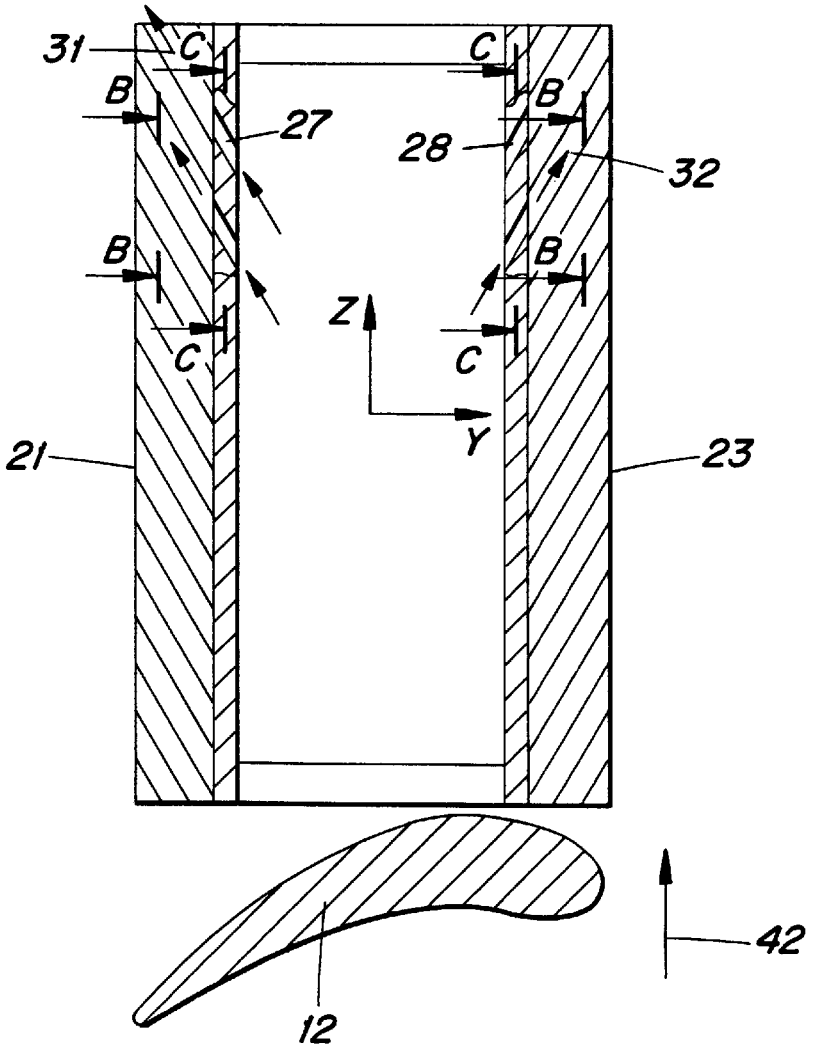
FIG. 3 shows the longitudinal section through the heat-shield segment according to FIG. 2 in the section plane A—A.

The individual heat-shield segments 17 are curved plates which have rails on their longitudinal sides, i.e. the sides orientated transversely to the direction of flow or to the turbine axis, and these rails run in the circumferential direction, are possibly provided with recesses and in each case comprise a pair of arms 21, 22 and 23, 24 respectively which project in the axial direction, run in parallel and are at a distance from one another (in this respect also see the comparable FIG. 3 of U.S. Pat. No. 5,071,313). The heat-shield segments 17, while forming a cavity 20, are fastened to the inside of a concentrically encircling, annular carrier 16. The fastening is effected in each case via two clamps 18 and 19, which, with ends bent inward in an L-shape, engage from both sides under the carrier 16 in the intermediate spaces 25 and 26 respectively formed between the arm pairs 21, 22 and 23, 24. In order to have sufficient clearance for different thermal expansion, radial gaps 29 and 30 are left free between the clamps 18 and 19 and the respectively adjacent wall elements 15 and 14.

Figure 4:
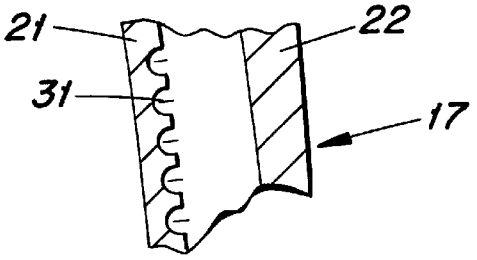
FIG. 4 shows the section through the longitudinal edges of the segment from FIG. 3 in the section plane B—B.
Figure 5:
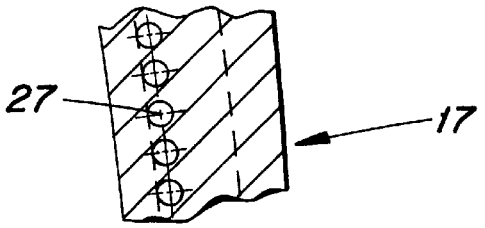
FIG. 5 shows the section through the longitudinal edges of the segment from FIG. 3 in the section plane C—C.
Figure 6:
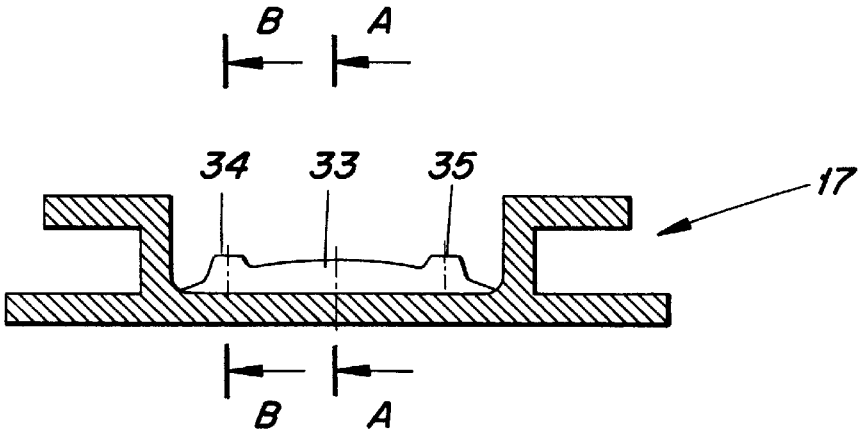
FIG. 6 shows the cross section, comparable with FIG. 2, through a heat-shield segment in a further preferred exemplary embodiment of the invention, with integrally formed, rear, axial stiffening ribs and supporting pins for an impingement-cooling plate.
Figure 7:
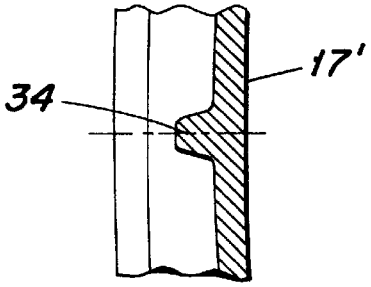
FIG. 7 shows the section through the heat-shield segment from FIG. 6 in the section plane B—B.
Figure 8:
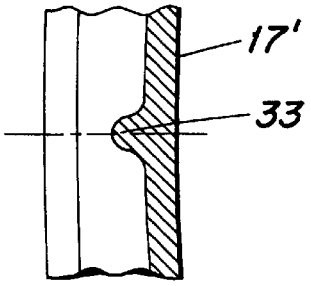
FIG. 8 shows the section through the heat-shield segment from FIG. 6 in the section plane A—A.

The heat-shield segments 17 are cooled from outside via the cavity 20. Compressed air is let into this cavity at one point (not shown) from the plenum of the gas turbine and then flows out through cooling holes 27, 28, arranged at both longitudinal sides of the heat-shield segment 17, into the intermediate spaces 25 and 26 between the arm pairs 21, 22 and 23, 24 (see the curved arrows in the cavity 20 of FIG. 1). The cooling holes 27, 28 are arranged in such a way that the cooling air flows through between the insides (bottom sides) of the ends, bent in an L-shape, of the clamps 18, 19 and the outsides (top sides) of the inner arms 21, 23 outward into the gaps 29 and 30 and discharges from there into the hot-gas duct 11. So that the cooling-air flow can take place largely without hindrance, cooling slots 31, 32 in alignment with the cooling holes 27, 28 are made in the outsides of the inner arms 21, 23. FIG. 3 shows these cooling slots 31, 32 in plan view, and FIGS. 4 and 5 show the cooling slots and cooling holes respectively in cross section.

Several requirements are fulfilled in a reliable and simple manner by the type of cooling-air guidance described: since the cooling air discharges evenly from the cavity 20 on both longitudinal sides, cooling air is admitted to the base of the cavity 20 or the outside of the heat-shield segment in an even manner and over the full surface, so that local overheating is reliably avoided. At the same time, this prevents too much heat caused by heat conduction from passing into the outer arms 22, 24 and from there further into the carrier. Furthermore, the clamps 18, 19 are effectively cooled at their angled ends, so that they too conduct only a little heat to the outside. In addition, the inner arms 21, 23 are also effectively protected against overheating. Finally, due to the discharging cooling air, the gaps 29, 30 are flooded with cooling air, as a result of which undesirable ingress of hot gas into the gaps is reliably avoided. In this, connection, it is especially favorable from a fluidic point of view, if, as can be seen from the representation in FIG. 3, the cooling holes 27, 28 and the cooling slots 31, 32 in alignment with them are arranged in the plane of the heat-shield segment 17 in such a way as to slant away from the axial direction in the direction of rotation 42 of the moving blade 12 or gas turbine.

As already explained further above, the position of the heat-shield segments 17 substantially determines the gap between the heat shield and the outer end of the moving blades 12. On the one hand, this gap is to be as small as possible in order to minimize efficiency losses. On the other hand, the gap must be sufficiently large in order to avoid, where possible, abrasive contact between moving blades and heat shield at various temperatures and during the different expansions of the elements associated therewith. In order to keep the tolerances close, it is of advantage to reduce the temperature-induced bending of the heat-shield segments by arranging axial stiffening ribs 33, which run from one longitudinal side to the other, on the outside of the heat-shield segments 17' according to FIGS. 6 to 10. These stiffening ribs 33 may advantageously be integrally formed during the casting of the heat-shield segments 17'.

It is especially favorable if lugs or pins 34, 35 projecting radially outward are at the same time also integrally formed in a distributed manner with and inside the stiffening ribs 33, on which lugs or pins 34, 35 an impingement-cooling plate 36 (FIGS. 9, 10) encircling the heat shield inside the cavities 20 can then be supported. The impingement-cooling plate 36, without special shaping, may thus be placed close to the outside of the heat-shield segments 17', as a result of which the cooling effect of the cooling air flowing through the openings 37 in the impingement-cooling plate 36 is markedly increased. At the same time, the lugs or pins 34 increase the heat-transfer area and provide for additional swirling of the cooling air.

A further improvement in the cooling can be achieved, or local overheating due to an undesirable cooling-air discharge can be prevented, if undesirable cooling-air losses are effectively limited or are completely avoided. To this end, according to FIG. 11, axial elastic seals 39, 41 may be provided between the ends, bent in an L-shape, of the clamps 18, 19 and the opposite longitudinal sides of the heat-shield segments 17, these seals 39, 41 preventing the cooling air which flows out of the cooling holes 27, 28 from flowing off into the gaps between the clamps 18, 19 and the carrier 16. Since the cooling air sweeps directly past the seals 39, the seals are at the same time effectively cooled. Additional axial elastic seals 38, 40 which are arranged between the clamps 18, 19 and the carrier 16 further improve the sealing. The advantage of this sealed arrangement, on the one hand, consists in the fact that hot gas is prevented from intruding and leading to local overheating. On the other hand, the cooling-air leakage is minimized and the cooling air is used for cooling at locations where it is actually required. The reduced leakage and the concerted use of cooling air lead to an improvement in the efficiency of the turbine stage or of the machine overall.

What is claimed is:

1. A heat shield for a gas turbine, which heat shield encloses in an annular manner the moving blades, rotating in the hot-gas duct of the gas turbine, of a stage of the gas turbine and comprising: a plurality of heat-shield segments which are arranged one behind the other in the circumferential direction, are curved in the shape of a segment of a circle and are cooled from outside, and the longitudinal sides of which are designed as correspondingly curved rails running in the circumferential direction and having in each case a pair of arms which project in the axial direction, run in parallel and are at a distance from one another, the heat-shield segments, while forming a cavity to which cooling air can be admitted, are fastened to the inside of an annular carrier, which concentrically surrounds the heat shield in such a way that in each case a radial gap is formed between the longitudinal sides of the heat-shield segments and the adjacent elements which define the hot-gas duct on the outside, wherein cooling holes are provided in both longitudinal sides of the heat-shield segments, through which cooling holes cooling air flows from the cavity into the intermediate spaces formed between the arm pairs and flows from there into the gaps.

2. The heat shield as claimed in claim 1, wherein the heat-shield segments are fastened to the carrier by means of clamps, which, with ends bent inward in an L-shape, engage from both sides under the carrier in the intermediate spaces formed between the arm pairs, and in that the cooling air flowing out of the cooling holes is directed in the intermediate spaces between the ends, bent inward in an L-shape, of the clamps and the inner arms of the heat-shield segments to the gaps.

3. The heat shield as claimed in claim 2, wherein cooling slots in alignment with the cooling holes are made in the outsides of the inner arms in order to direct the cooling air discharging from the cooling holes.

4. The heat shield as claimed in claim 3, wherein the cooling holes and cooling slots are arranged in the plane of the heat-shield segment in such a way as to slant away from the axial direction in the direction of rotation of the gas turbine.

5. The heat shield as claimed in one of claim 1, wherein to reduce the deflection of the heat shield during temperature changes, axially running stiffening ribs are arranged or integrally formed on the outside of the heat-shield segments in the region of the cavity.

6. The heat shield as claimed in claim 5, wherein an impingement-cooling plate running in the circumferential direction and provided with openings is arranged inside the cavity and at a distance from the outside of the heat-shield segments, and in that individual lugs or pins, which project radially outward and on which the impingement-cooling plate is supported, are arranged inside the stiffening ribs.

7. The heat shield as claimed in claim 2, wherein to prevent the cooling air from flowing off to the outside, first axial elastic seals are arranged above the cooling holes between the clamps and the longitudinal sides of the heat-shield segments.

8. The heat shield as claimed in claim 7, wherein second axial, elastic seals are additionally arranged between the clamps and the carrier.

9. A heat shield for a gas turbine, comprising:

at least one blade enclosed by the heat shield;

a hot-gas duct of the gas turbine;

a plurality of heat-shield segments forming a cavity to which cooling air can be admitted;

said plurality of heat-shield segments fastened to an annular carrier, which concentrically surrounds the heat shield in such a way so as to form a radial gap between longitudinal sides of the heat-shield segments and adjacent elements which define the hot-gas duct;

plurality of holes are provided in the longitudinal sides of the heat-shield segments; and a plurality of arm pairs for the heat-shield segments, and cooling air flow form the cavity into a plurality of intermediate spaces formed between the arm pairs.

* * * * *